US005922983A

United States Patent [19]

Muramatsu

[11] Patent Number: 5,922,983

[45] Date of Patent: Jul. 13, 1999

[54] KEYBOARD MUSICAL INSTRUMENT HAVING KEY TOUCH CONTROLLER

[75] Inventor: Shigeru Muramatsu, Shizuoka, Japan

[73] Assignee: Yamaha Corporation, Japan

[21] Appl. No.: 08/951,238

[22] Filed: Oct. 16, 1997

[30] Foreign Application Priority Data

Oct. 18, 1996 [JP] Japan ..... 8-276639
Oct. 2, 1997 [JP] Japan ..... 9-270094

[51] Int. Cl.[6] ..... G10C 3/12; G10C 3/16

[52] U.S. Cl. ..... 84/626; 84/615; 84/662; 84/718; 84/720; 84/743; 84/745

[58] Field of Search ..... 84/615–619, 626–627, 84/653–658, 718–720, 743–745, 662, 663

[56] References Cited

U.S. PATENT DOCUMENTS 4,899,631 2/1990 Baker ..... 84/719

FOREIGN PATENT DOCUMENTS 5-11765 1/1993 Japan .
7-111631 11/1995 Japan .

*Primary Examiner*—John W. Cabeca
*Assistant Examiner*—Marlon T. Fletcher
*Attorney, Agent, or Firm*—Ostrolenk, Faber, Gerb & Soffen, LLP

[57] ABSTRACT

An electronic keyboard musical instrument stores first key touch data codes representative of a first reaction component and grouped into first data groups by a key velocity, second key touch data codes representative of a second reaction component and grouped into second data groups by a key position and third key touch data codes representative of a third reaction component and grouped into third data groups by the key position, and produces a digital key position signal representative of current key position, a digital key velocity signal representative of current key velocity and a digital key acceleration signal representative of current key acceleration so that a solenoid-operated actuator generates a resistance against the key motion on the basis of the first key touch data code selected by using the digital key position signal and the digital key velocity signal, the second key touch data code selected by using the digital key velocity signal and the digital key position signal and the third key touch data code selected by using the digital key acceleration code and the digital key position code, thereby giving a key touch close to a piano key touch.

10 Claims, 7 Drawing Sheets

KEYBOARD MUSICAL INSTRUMENT HAVING KEY TOUCH CONTROLLER

FIELD OF THE INVENTION

This invention relates to an electronic keyboard musical instrument and, more particularly, to an electronic keyboard musical instrument equipped with a key touch controller reproducing the key touch of an acoustic piano, a method of simulating a key touch and an information storage medium for storing the program sequence thereof.

DESCRIPTION OF THE RELATED ART

The electronic keyboard musical instrument has black/white keys usually laid on the pattern of the keyboard of an acoustic piano. The black/white key of the acoustic piano actuates the key action mechanism, and causes the hammer to escape from the key action mechanism for free rotation. Moreover, the black/white key, the parts of the key action mechanism and the hammer are made of wood, and are bent during the transmission of the key motion. Thus, the black/white key of the acoustic piano delicately varies the reaction against the finger of the pianist, and the pianist feels the reaction against the finger complicated. The reaction from the black/white key of the acoustic piano is hereinbelow referred to as "piano key touch".

On the other hand, the reaction from the black/white keys of a typical electronic keyboard musical instrument is simple. Any key action mechanism is linked with the black/white key, and only a spring urges the black/white key toward the rest position. While a player is depressing the black/white key from the rest position toward the end position, the reaction against the finger is simply increased together with the distance from the rest position, and the player feels the key touch different from the piano key touch.

A user would like to play an electronic keyboard musical instrument with a piano key touch, and a key touch controller has been developed for this purpose. The key touch controller is, by way of example, disclosed in Japanese Patent Publication of Examined Application No. 7-111631 and Japanese Patent Publication of Unexamined Application No. 5-11765, and is implemented by solenoid-operated actuators associated with a controlling unit. The plungers are held in contact with the black/white keys, and the controller varies the amount of driving current supplied to the solenoid-operated actuator depending upon the key position on the trajectory from the rest position to the end position. The driving current causes the solenoid-operated actuator to exert force on the plunger against the depressed black/white key. The player feels the resistance against the key motion as key touch. However, the prior art key touch controller can not reproduce the piano key touch, because the controlling unit assumes the piano key touch to be a simple function.

SUMMARY OF THE INVENTION

It is therefore an important object of the present invention to provide a key touch controller which exactly simulates the piano key touch.

It is another important object of the present invention to provide a method of simulating the piano key touch.

It is also an important object of the present invention to provide an information storage medium which stores a program sequence of the method.

To accomplish the object, the present invention proposes to select a piece of reaction data information by using different physical quantities.

In accordance with one aspect of the present invention, there is provided a keyboard musical instrument comprising at least one key movable between a rest position and an end position, a first monitoring means associated with the at least one key and producing a first signal representative of a first physical quantity varied between the rest position and the end position for defining current status of the at least one key from a certain angle, a second monitoring means provided for the at least one key and producing a second signal representative of a second physical quantity varied between the rest position and the end position and different from the first physical quantity for defining the current status of the at least one key from another angle, a first data table storing first pieces of reaction data information representative of a first reaction component to a motion of the at least one key, grouped by the first physical quantity and responsive to the first signal for selecting a group of first pieces of reaction data information and to the second signal for selectively outputting the first pieces of reaction data information of the group and a reaction generating means responsive to the first pieces of reaction data information selectively outputted for giving a resistance against the motion of the at least one key.

In accordance with another aspect of the present invention, there is provided a keyboard musical instrument comprising at least one key movable between a rest position and an end position, a monitoring means associated with the at least one key and producing a signal for defining current status of the at least one key, a data table storing pieces of reaction data information and divided into a first group representative of a motion of the at least one key from the rest position and the end position and a second group representative of a motion of the at least one key from the end position to the rest position and responsive to the signal for selectively reading out the pieces of reaction data information, a selecting means for selecting the first group or the second group depending upon a direction of the motion of the at least one key and a reaction generating means responsive to the pieces of reaction data information selectively outputted from the first group or the second group specified by the selecting means for giving a resistance against the motion of the at least one key.

In accordance with yet another aspect of the present invention, there is provided a method of controlling a key touch of a key forming a part of a keyboard comprising the steps of a) determining a physical quantity representative of a motion of the key, b) determining a direction of the motion on the basis of the physical quantity and a magnitude of a force on the basis of the direction and the physical quantity, and c) exerting the force on the key.

In accordance with yet another aspect of the present invention, there is provide a method of controlling a key touch of a key forming a part of a keyboard comprising the steps of a) determining a physical quantity representative of a motion of the key, b) determining a variation of the physical quantity varied with time on the basis of the physical quantity and a magnitude of a force on the basis of the physical quantity and the variation, and c) exerting the force on the key.

In accordance with yet another aspect of the present invention, there is provided a method of controlling a key touch of a key forming a part of a key board comprising the steps of a) determining more than one physical quantity representative of a motion of the key and including a key velocity, b) determining a magnitude of a force on the basis of the more than one physical quantity, c) determining whether or not a back check vibrates on the basis of the key velocity, d) determining an additional force when the back check vibrates, and e) exerting the total of the force and the additional force on the key.

In accordance with yet another aspect of the present invention, there is provided an information storage medium for storing a program, and the program comprises the steps of a) determining whether a key is moved toward an end position or toward a rest position on the basis of a physical quantity representative of a motion of the key, b) determining a magnitude of a force on the basis of the direction of the key motion and the physical quantity, and c) exerting the force on the key.

In accordance with yet another aspect of the present invention, there is provided an information storage medium for storing a program, and the program comprises the steps of a) determining a magnitude of a force on the basis of more than one physical quantity representative of a motion of a key and including a key velocity, b) determining whether a back check vibrates or not, c) determining an additional force when the back check vibrates, and d) exerting the total of the force and the additional force on the key.

In accordance with yet another aspect of the present invention, there is provided an information storage medium for storing a program, and the program comprises the steps of a) determining a magnitude of a force on the basis of a physical quantity representative of a motion of a key and a variation of the physical quantity varied with time, and b) exerting the force on the key.

BRIEF DESCRIPTION OF THE DRAWINGS

The features and advantages of the key touch controller will be more clearly understood from the following description taken in conjunction with the accompanying drawings in which.

DESCRIPTION OF THE PREFERRED EMBODIMENT

Analysis of Key Reaction

Figure 1:
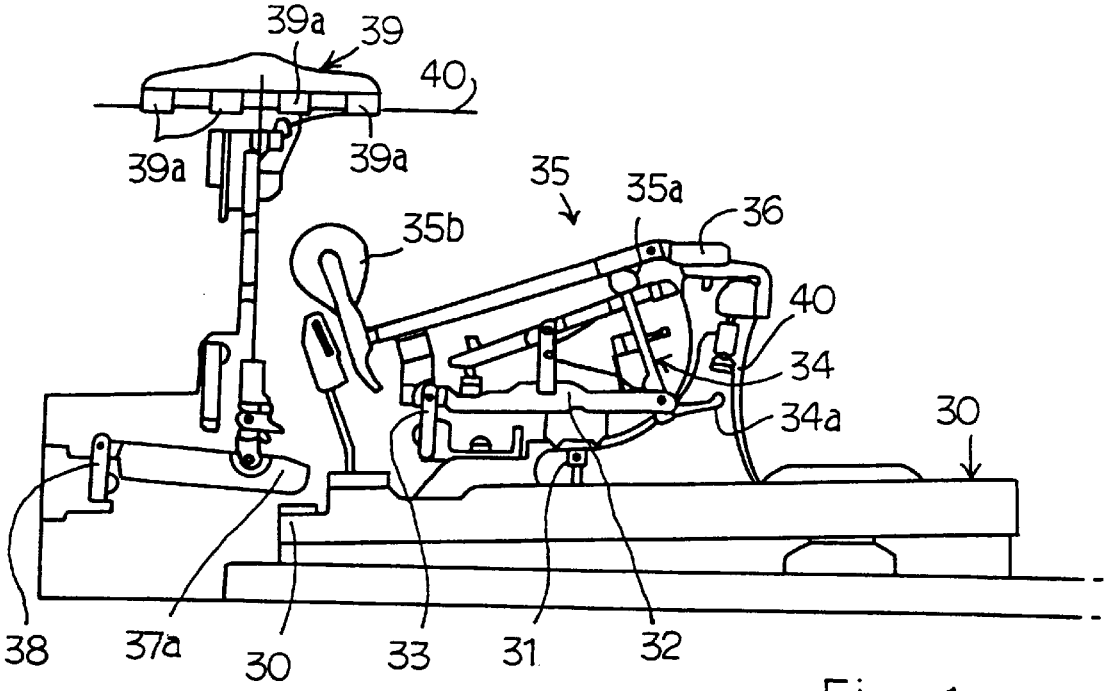
FIG. 1 is a side view showing the structure of a key action mechanism incorporated in a grand piano.

First, the behavior of a standard key action mechanism is described. FIG. 1 illustrates the standard key action mechanism incorporated in an acoustic grand piano. Assuming now that a pianist depresses a key 30, a capstan button 31 upwardly pushes the whippen assembly 32, and the whippen assembly 32 turns around a whippen flange 33. A jack 34 also turns around the whippen flange 33, and pushes a hammer roller 35*a* of a hammer assembly 35. For this reason, the hammer assembly 35 turns around a shank flange 36.

Subsequently, the rear end portion 30*a* is brought into contact with a damper lever 37, and causes the damper lever 37 to turn around a damper flange 38. The damper lever 37 lifts the damper assembly 39, and damper felts are spaced from a set of strings 40.

Subsequently, the tow 34*a* of the jack 34 is brought into contact with a regulating button 40, and restricts the rotation of the jack 34 around the whippen flange 33. The jack 34 turns around a whippen assembly 32, and kicks the hammer roller 35*a*. Then, the hammer roller 35*a* escapes from the jack 34, and the hammer assembly 35 starts free rotation toward the set of strings 40. A hammer felt 35*b* strikes the set of strings 40, and rebound thereon.

When the pianist releases the key 30, the key 30 starts the following backward motion toward the rest position. The rear end portion 30*a* is sunk, and allows the hammer assembly 35 to bring the hammer felts 35*b* into contact with the set of strings 40. Thereafter, the rear end portion 30*a* is spaced from the damper lever 37. Finally, the key 30 returns to the rest position. Thus, the key action mechanism complicatedly behaves, and the key 30 also complicatedly varies the reaction to the finger.

Figure 2:
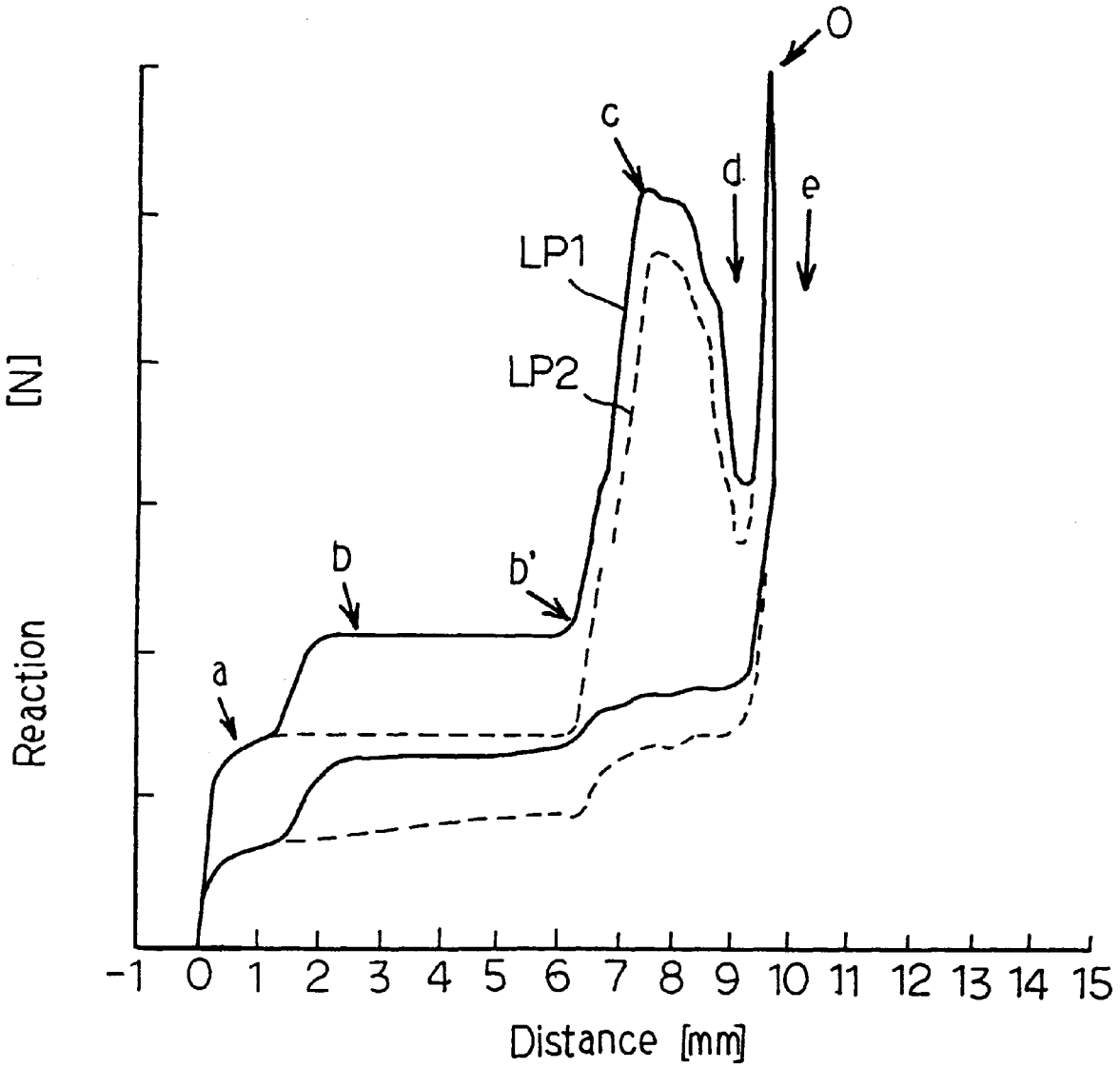
FIG. 2 is a graph showing relation between reaction from a key and a key position.

FIG. 2 shows the reaction during the motion of the key 30 gently depressed from the rest position to the end position and vice versa. The jack 34 starts to push the hammer roller 35*a* at point a, and the rear end portion 30*a* is brought into contact with the damper lever 37 at point b. The jack 34 is brought into contact with the regulating button 40 at point b', and the hammer assembly 35 escapes from the jack 34 at point c. After the escape, the reaction is drastically decreased as indicated by "d". The key 30 starts the backward motion at point o, and the reaction is rapidly increased. Thereafter, the reaction is decreased as indicated by "e". Thus, the damper assembly 39, the hammer assembly 35, the jack 34 and the regulating button 35*a* produces the reaction to the depressed key 30, and the pianist feels the reaction to be the resistance against the finger. The resistance is varied along a hysteresis loop LP1.

When the pianist pushes down a damper pedal (not shown), the damper pedal keeps the damper felts 39*a* off, and the damper assembly 39 does not affect the reaction. In this situation, the reaction is also varied along a hysteresis loop LP2. The key 30 is depressed so gentle that the key velocity is ignoreable. FIG. 2 teaches us that the key position has an important influence on the reaction.

Figure 3:
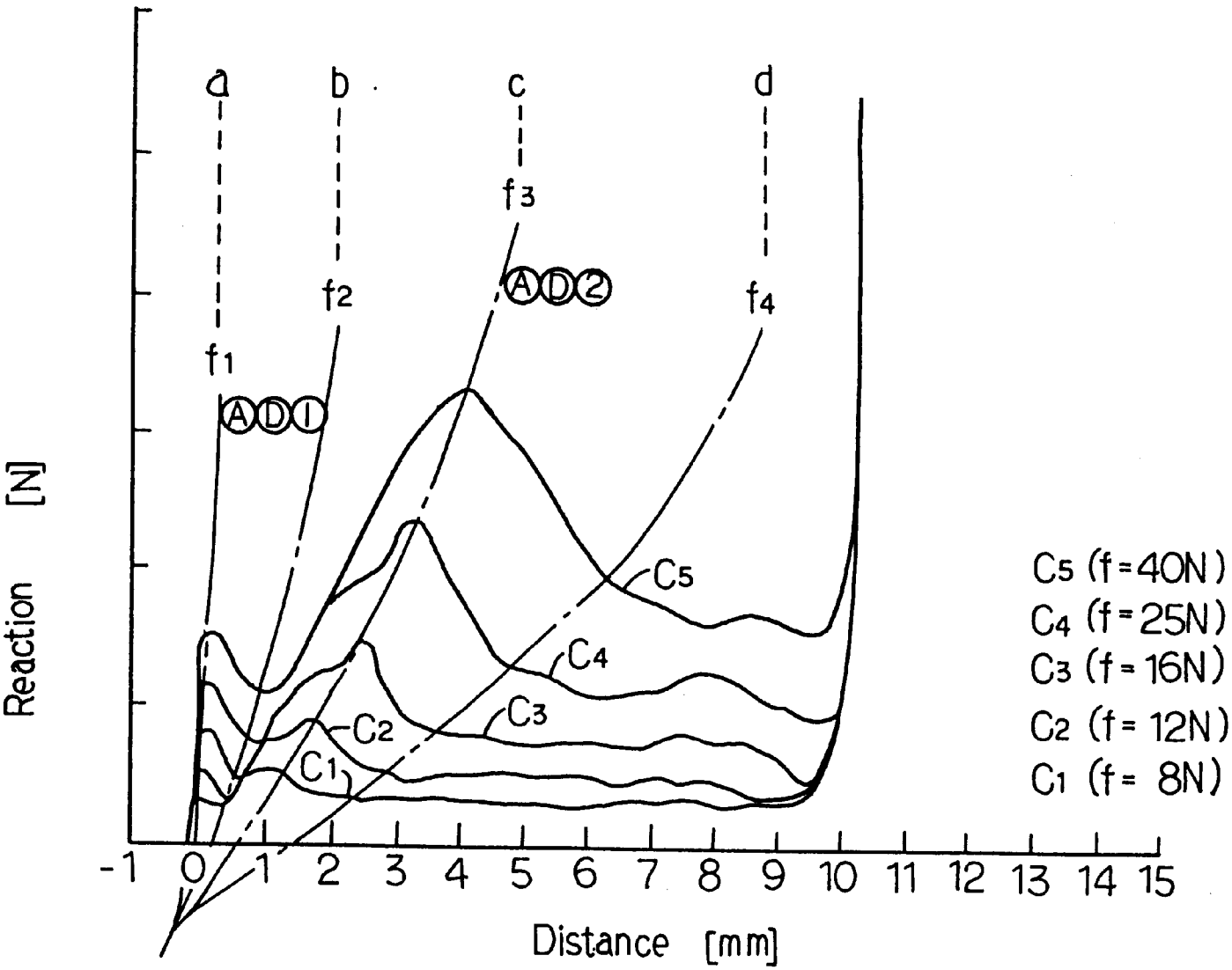
FIG. 3 is a graph showing relation between reaction from the key and a key velocity.

On the other hand, when the pianist depresses the key 30 at different forces, the hammer assembly 35 is rotated at different speeds, and strikes the set of strings 40 at different intensities. FIG. 3 illustrates the relation between the reaction and the distance from the rest position. Plots C1, C2, C3), C4 and C5 indicate the relation at difference forces exerted on the key 30. When the key 30 is depressed at 8 newtons, 12 newtons, 16 newtons, 25 newtons and 40 newtons, the reaction is varies along plots C1, C2, C3, C4 and C5, respectively. The reaction was measured by using an automatic player piano, i.e., an acoustic piano equipped with solenoid-operated key actuators for selectively actuating the black/white keys, and the force was determined on the basis of the electric power. FIG. 3 teaches us that the key velocity had an important influence on the reaction.

Arrangement of Electronic Keyboard Musical Instrument

Figure 4:
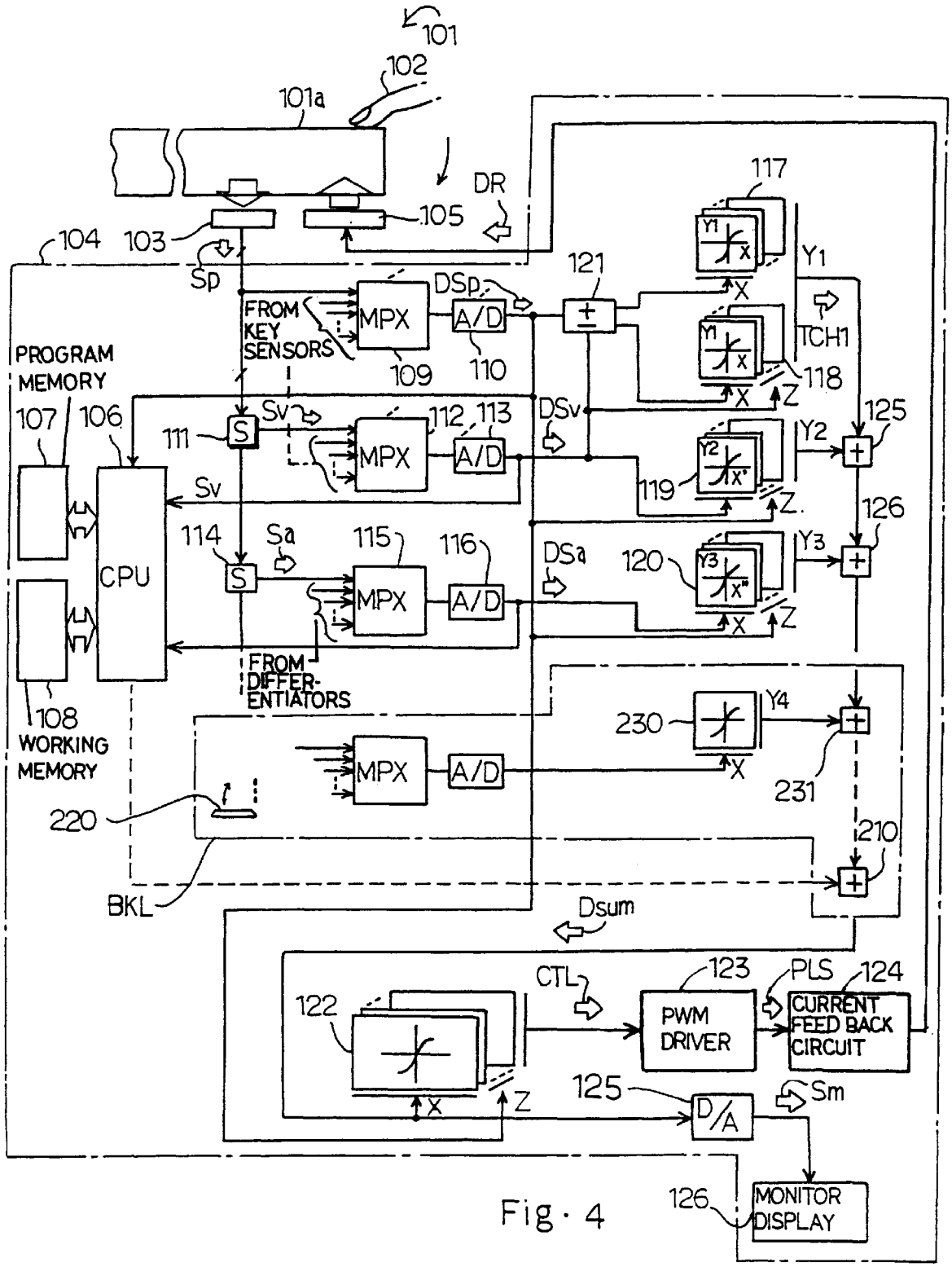
FIG. 4 is a block diagram showing the arrangement of a key touch controller according to the present invention.

Referring to FIG. 4 of the drawings, a key touch controller embodying the present invention is provided in association with eighty-eight black/white keys 101*a* incorporated in an electronic keyboard musical instrument 101. Although the electronic keyboard musical instrument includes a tone generator and a speaker system for generating sounds, they are deleted from FIG. 4, because they are less important for understanding the present invention. The black/ white keys 101*a* are laid out on the pattern of the keyboard of an acoustic piano, and are turnable along respective trajectories between respective rest positions and respective end positions. The black/white key 101*a* stays at the rest position without force. When a finger 102 depresses the black/white key 101*a*, the black/white key 101*a* is moved from the rest position toward the end position. Circuit components in the broken line BKL are added to the controlling unit 104 for modifications.

The key touch controller embodying the present invention largely comprises a plurality of key sensors 103, a controlling unit 104 and a plurality of solenoid-operated actuators 105. The plurality of key sensors 103 are respectively associated with the black/white keys 101*a*, and the plurality of solenoid-operated actuators 105 are also associated with the black/white keys 101*a*, respectively. The key sensor 103 monitors the associated black/white key 101*a*, and produces a key position signal Sp representative of the current key position on the trajectory. The key sensor 103 includes a shutter plate attached to the lower surface of the associated black/white key 101*a* and a photo-interrupter mounted on a key bed beneath the associated black/white key 101*a*. The photo-interrupter radiates a light beam across the trajectory of the associated black/white key 101*a*, and the shutter plate gradually interrupts the light beam on the way toward the end position. The amount of light or light intensity is varied together with the distance from the rest position, and the photo-interrupter converts the light intensity to the key position signal Sp.

The solenoid-operated actuator 105 includes a solenoid wound on a bobbin and a plunger projectable from and retractable into the bobbin. A cushion member is attached to the leading end of the plunger, and the plunger is held in contact with the lower surface of the associated black/white key 101*a* through the cushion member. A driving signal DR is supplied from the controlling unit 104 to the solenoid-operated actuator 105, and energizes the solenoid. The solenoid generates magnetic force, and projects the plunger so as to provide resistance against the key motion. The magnetic force is varied together with the amount of electric power supplied to the solenoid, and the controlling unit 104 varies the driving signal for controlling the resistance.

Subsequently, description is made on the controlling unit 104. The controlling unit 104 includes a central processing unit 106, and the central processing unit 106 is associated with a program memory 107 and a working memory 108. The program memory 107 is implemented by a read only memory device, and stores instruction codes for a program executed by the central processing unit 106. On the other hand, the working memory 108 is implemented by a random access memory device, and temporarily stores data codes, status flags and so forth.

The controlling unit 104 further includes multiplexers 109 selectively connected to the key sensors 103 and analog-to-digital converters 110 connected to the respective output terminals of the multiplexers 109. The twelve black/white keys 101*a* form a key group for one octave, and each of the multiplexers 109 has twelve input terminals connected to the twelve key sensors 103 for the key group. In this instance, the eighty-eight black/white keys 101*a* form eight key groups, and, accordingly, the eight key groups are respectively connected to eight multiplexers 109. The multiplexer 109 sequentially connects the twelve input terminals to the associated analog-to-digital converter 110. The key position signals Sp are sequentially transferred to the analog-to-digital converter, and the analog-to-digital converter converts the key position signal Sp to a digital key position code DSp. Thus, the eight multiplexers 109 periodically scans the eighty-eight key sensors 103, and the eight analog-to-digital converters 110 produces the digital key position codes DSp representative of the current key positions of the eighty-eight black/white keys 101*a*.

The controlling unit 104 further includes eighty-eight differentiators 111 connected to the eighty-eight key sensors 103, eight multiplexers 112 selectively connected to the differentiators 111 and eight analog-to-digital converters 113 respectively connected to the multiplexers 112. The key position signal Sp is supplied from each key sensor 103 to the associated differentiator 111, and the differentiator 111 calculates a key velocity X' from variation of the key position X. The differentiator 111 generates a key velocity signal Sv representative of the current key velocity X'. The key sensors 103 for each key group are respectively connected to the differentiators 111, which form a differentiator group. The differentiator groups are respectively associated with the multiplexers 112, and each of the multiplexers 112 also has twelve input terminals. The differentiators 111 of each group are respectively connected to the input terminals of the associated multiplexer 112, and the multiplexer 112 periodically connects the input terminals thereof to the associated analog-to-digital converter 113. The key velocity signals Sv are periodically transferred from the eighty-eight differentiators 111 through the multiplexers 112 to the analog-to-digital converters 113, and the analog-to-digital converter 113 converts each of the key velocity signals Sv to a digital key velocity code DSv. Thus, the eighty-eight differentiators 111, the eight multiplexers 112 and the eight analog-to-digital converters 113 periodically produce the eighty-eight digital key velocity codes DSv respectively representative of the current key velocities X' of the eighty-eight black/white keys 101*a*. The digital key velocity codes DSv are produced in synchronism with the generation of the digital key position codes DSp.

The controlling unit 104 further includes eighty-eight differentiators 114 connected to the eighty-eight differentiators 111, eight multiplexers 115 selectively connected to the differentiators 114 and eight analog-to-digital converters 116 respectively connected to the multiplexers 115. The key velocity signal Sv is supplied from each differentiator 111 to the associated differentiator 114, and the differentiator 114 calculates a key acceleration X" from variation of the key velocity X'. The differentiator 114 generates a key acceleration signal Sa representative of the current key acceleration X", and supplies the key acceleration signal Sa to the associated multiplexer 115. The differentiators 111 of each group are respectively connected to the differentiators 114, which also form a differentiator group. The differentiator groups are respectively associated with the multiplexers 115, and each of the multiplexers 115 has twelve input terminals. The differentiators 114 of each group are respectively connected to the input terminals of the associated multiplexer 115, and the multiplexer 115 periodically connects the input terminals thereof to the associated analog-to-digital converter 116. The key acceleration signals Sa are periodically transferred from the eighty-eight differentiators 114 through the multiplexers 115 to the analog-to-digital converters 116, and the analog-to-digital converter 116 converts each of the key acceleration signals Sa to a digital key acceleration code DSa. Thus, the eighty-eight differentiators 114, the eight multiplexers 115 and the eight analog-to-digital converters 116 periodically produce the eighty-eight digital key velocity codes DSa respectively representative of the current key accelerations X" of the eighty-eight black/white keys 101*a*. The digital key acceleration codes DSa are produced in synchronism with the generation of the digital key position codes DSp and the generation of the digital key velocity codes DSv.

The controlling unit 104 further includes data tables 117, 118, 119 and 120, a selector 121 connected between the analog-to-digital converter 110 and the data tables 117/118, a modification table 122, a pulse-width modulation driver 123, a current feedback circuit 124 and adders 125/126.

The data tables 117 to 120 store key touch data codes representative of components of target reaction to be required. The selector 121 is connected between the analog-to-digital converter 110 and an address ports of the data tables 117/118, and the output ports of the data tables 117/118 is connected to an input node of the adder 125. The analog-to-digital converters 110/113 are connected to an address port of the data table 119, and an output port of the data table 119 is connected to the other input port of the adder 125. An output port of the adder 125 is connected to an input port of the adder 126. The analog-to-digital converters 110/116 are connected to an address port of the data table 120, and an output port of the data table 120 is connected to the other input port of the adder 126. An analog-to-digital converter 110 is further connected to an address port of the modification table 122, and an output port of the adder 126 is electrically connected to the address port of the modification table 122. All of the analog-to-digital converters 110/113/116 are further connected to data input ports of the central processing unit 106.

As described hereinbefore, two data tables 117 and 118 are associated with the analog-do-digital converter 110, and the analog-to-digital converter 110 selectively supplies the digital key position code DSp through the selector 121 to the data tables 117/118. When a black/white key 101*a* is depressed, the current key position Sp is increased with time, and the selector 121 steers the digital key position code DSp to the address port of the data table 117. On the other hand, when the black/white key 101*a* is released, the current key position Sp is decreased with time, and the selector 121 transfers the digital key position code DSp to the address port of the other data table 118. The selector 121 checks the sign bit of the digital key velocity code DSv, and selects one of the data tables 117/118. If the digital key velocity code DSv has the positive sign bit, the selector 121 decides the key 101*a* to be moved toward the end position, and the selector 121 steers the digital key position code DSp to the data table 117. On the other hand, if the digital key velocity code DSv has the negative sign bit, the selector decides the key 101*a* to return toward the rest position, and transfers the digital key position signal DSp to the data table 118. The selector 121 has a dead zone. When the current key velocity X' falls within the dead zone, the selector 121 does not change the data table as will be described hereinlater.

The first key touch data code Y1, the second key touch data code Y2 and the third key touch data code Y3 are respectively read out from the data table 117/118, the data table 119 and the data table 120, and the values of the key touch data codes Y1, Y2 and Y3 are added so as to produce a digital key touch data code Dsum representative of the target reaction Sum against the associated key 101*a*. Even if the driving current is unchanged, the solenoid-operated actuator varies the thrust depending upon the position of the plunger. The modification table 122 corrects the target reaction Sum represented by the digital key touch data code Dsum, and modifies the target reaction Sum in consideration of the electromagnetic characteristics of the solenoid-operated actuators 105.

Using the output of the modification table 122 as a control signal CTL representative of a pwm command value, the pulse width modulation driver 123 changes the pulse width of a driving pulse signal PLS, and the current feedback circuit 124 distributes the driving signals DR to the solenoid-operated actuators 105.

Figure 5:
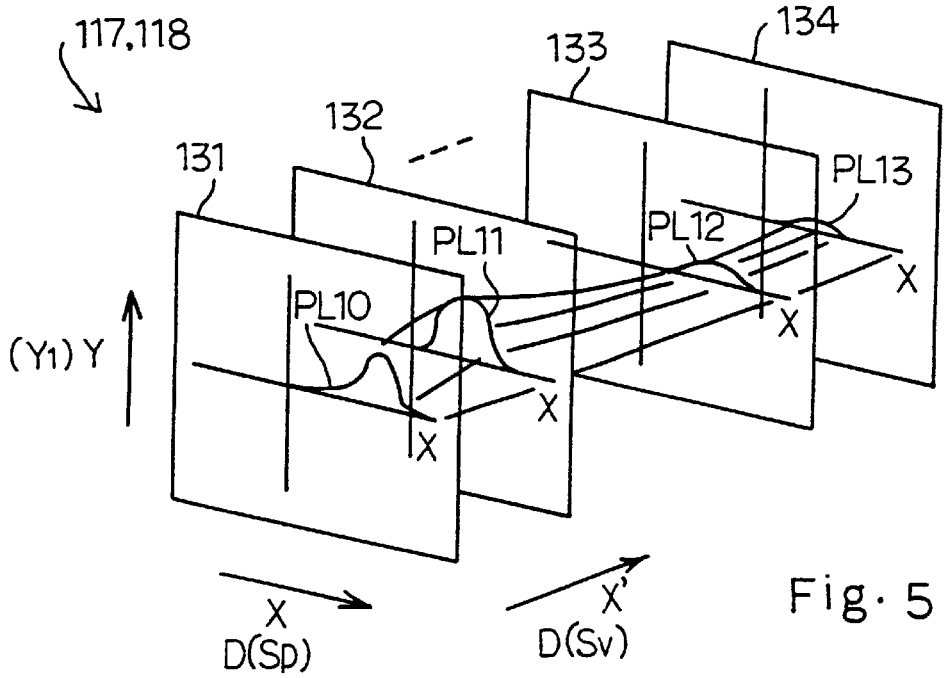
FIG. 5 is a schematic view showing a data arrangement stored in data tables.

The data tables 117/118 are addressed by using the digital key position code DSp representative of the current key position and the digital key velocity code DSv representative of the current key velocity. The first key touch data codes are grouped by the key velocity as shown in FIG. 5, and the groups of first key touch data codes Y1 are represented by plots PL10, PL11, . . . PL12 and PL13 on respective planes 131, 132, . . . 133, 134. The digital key velocity code DSv specifies one of the planes 131 to 134, and the digital key position code DSp selects the first digital key touch code Y1 from the selected data group 131 to 134. The key velocities of the data groups 131 to 134 are discrete, and the current key velocity X' is not always equal to the key velocity of one of the data groups 131 to 134. If there is not an appropriate data group for the current key velocity X', two data groups for the key velocities closest to the current key velocity X' are specified, and the first key touch data code for the current key velocity X' is calculated from two first key touch data codes at the current key position X in the selected data groups.

The second key touch data codes Y2 in the data table 119 are arranged in a similar manner to the first key touch data codes Y1. The second key touch data codes Y2 are grouped by the key position, and one of the data groups is selected by using the digital key position code DSp. The digital key velocity code DSv selects the second key touch data codes Y2 from the selected data group. If an appropriate data group is not incorporated in the data table 119, the second key touch data code Y2 is calculated from two data groups for key positions closest to the current key position X. The second key touch data code Y2 represents viscous load of the keyboard/key action mechanism varied together with the key position X.

The third key touch data codes Y3 in the data table 120 are arranged in a similar manner to the second key touch data codes Y2. The third key touch data codes Y3 are also grouped by the key position, and one of the data groups is selected by using the digital key position code DSp. The digital key acceleration code DSa selects the third key touch data codes Y3 from the selected data group. If an appropriate data group is not incorporated in the data table 120, the third key touch data code Y3 is calculated from two data groups for key positions closest to the current key position X. The third key touch data code Y3 represents inertial load of the keyboard/key action mechanism varied together with the key position X.

The modification table 122 stores the pwm command values, and the pwm command values are grouped by the key position. The digital key position code DSp selects one of the data groups, and the pwm command value is selected from the selected data group by using the digital key touch data code Dsum. If an appropriate data group is not found, two data groups are selected, and the pwm command value is calculated from the pwm command values at the given total reaction Sum stored in the selected two data groups. A solenoid-operated actuator does not produce constant thrust exerted to the plunger, and varies the thrust depending upon the position of the plunger. Therefore, even if a target reaction is matched with the thrust at a certain plunger position, the target reaction may be different from the thrust at another plunger position. For this reason, the controlling unit 104 modifies the target reaction through the modification table 122. The modification table 122 allows the manufacturer to arbitrarily select the solenoid-operated actuators 105 from various kinds of solenoid-operated actuator, and is conducive to optimization and reduction of the production cost.

The current feedback circuit 124 matches the electric power of the driving signal DR to the pwm command value. Moreover, even if the solenoid-operated actuator varies the electromagnetic characteristics due to undesirable temperature rise, the thrust of the plunger is regulated to the target reaction through the current feedback control.

The controlling unit 104 further includes a digital-to-analog converter 125 and a monitor display 126. The digital key touch data code Dsum is converted to an analog monitor signal Sm, and an analyst can confirm the variation of target reaction on the monitor display 126.

In this instance, the key sensors 103, the multiplexers 109, the analog-to-digital converters 110 as a whole constitute a first monitoring means, the key sensors 103, the differentiators 111, the multiplexers 112 and the analog-to-digital converters 113 form in combination a second monitoring means. The data tables 117 and 118 serve as a first data table, and the adders 125, the modification table 122, the pwm driver 123, the current feedback circuit 124 and the solenoid-operated actuator 105 as a whole constitute a reaction generating means. The data tables 119 and 120 serve as a second data table and a third data table, respectively. The key sensors 103, the differentiators 111, the differentiators 114, the multiplexers 115 and the analog-to-digital converters 116 as a whole constitute a third monitoring means.

Behavior of Electronic Keyboard Musical Instrument

Assuming now that a player depresses the black/white key 101*a* during a performance on the keyboard, the black/white key 101*a* varies the key position X with time, and the associated key sensor 103 detects the current key position X. The current key position X is reported from the key sensor 103 to the multiplexer 109 and the differentiator 111, and the differentiator 111 calculates the current key velocity X' on the basis of the current key position X and the previous key position. The current key velocity X' has a positive value, because the depressed key 110*a* is moved toward the end position. The current key velocity X' is transferred to the differentiator 114, and the differentiator 114 calculates the current key acceleration X" on the basis of the current key velocity X' and the previous key velocity. The current key velocity X' and the current key acceleration X" are respectively supplied to the multiplexers 112 and 115 as the key velocity signal Sv and the key acceleration signal Sa.

The multiplexers 109, 112 and 115 transfer the key position signal Sp, the key velocity signal Sv and the key acceleration signal Sa to the analog-do-digital converters 110, 113 and 116, and the key position signal Sp, the key velocity signal Sv and the key acceleration signal Sa are converted to the digital key position code DSp, the digital key velocity code DSv and the digital key acceleration code DSa, respectively.

The selector 121 checks the digital key velocity code DSv to see whether the sign bit represents a positive value or a negative value. The digital key velocity code DSv has the positive sign bit, and the selector 121 steers the digital key position code DSp to the data table 117. The digital key position code DSp is further supplied to the data tables 119/120 and the modification table 122, and the digital key velocity code DSv is supplied to the data tables 117 and 119. On the other hand, the digital acceleration code DSa is supplied to the data table 120. The first, second and third key touch codes Y1, Y2 and Y3 are read out form the data tables 117/119/120, and are supplied to the adders 125/126. The adder 125 adds the components of reaction represented by the first and second key touch data codes Y1 and Y2, and the sum is supplied to the other adder 126. The adder 126 adds the component of reaction represented by the third key touch data code Y3 to the sum, and supplies the digital key touch data code Dsum representative of the target reaction to the modification table 122.

The digital key touch data code Dsum and the digital key position code DSp are supplied to the modification table 122, and the control signal representative of the pwm command value is supplied to the pwm driver 123. The current feedback circuit 124 supplies the driving signal DR to the solenoid-operated actuator 105, and the solenoid-operated actuator 105 generates the thrust equivalent to the target reaction. The plunger pushes the depressed key 101*a* against the key motion, and the player feels the force exerted on the key 101*a* to be the resistance. The key sensor 103, the controlling unit 104 and the solenoid-operated key actuator 105 repeat the above described function, and vary the resistance.

When the player releases the depressed key 101*a*, the current key velocity X' has a negative value, and the selector 121 changes the destination of the digital key position code DSp from the data table 117 to the data table 118. The key sensor 103, the controlling unit 104 and the solenoid-operated actuator 105 repeat the function described hereinbefore, and gives the appropriate resistance to the player.

In this way, the controlling unit 104 cooperates with the key sensor 103 and the solenoid-operated actuator 105, and varies the resistance as similar to the piano key touch. The data tables 117/118, 119 and 120 respectively store the first, second and third key touch data codes Y1, Y2 and Y3 representative of the components of reaction differently originated in an acoustic piano. Each of the data tables 117 to 120 selects the key touch data code to be read out therefrom by using two parameters, i.e., the current key position X and the current key velocity X' or the current key position X and the current key acceleration X". For this reason, the solenoid-operated actuator 105 is controlled in such a manner as to vary the resistance as if the player depresses a black/white key of an acoustic piano.

Figure 6:
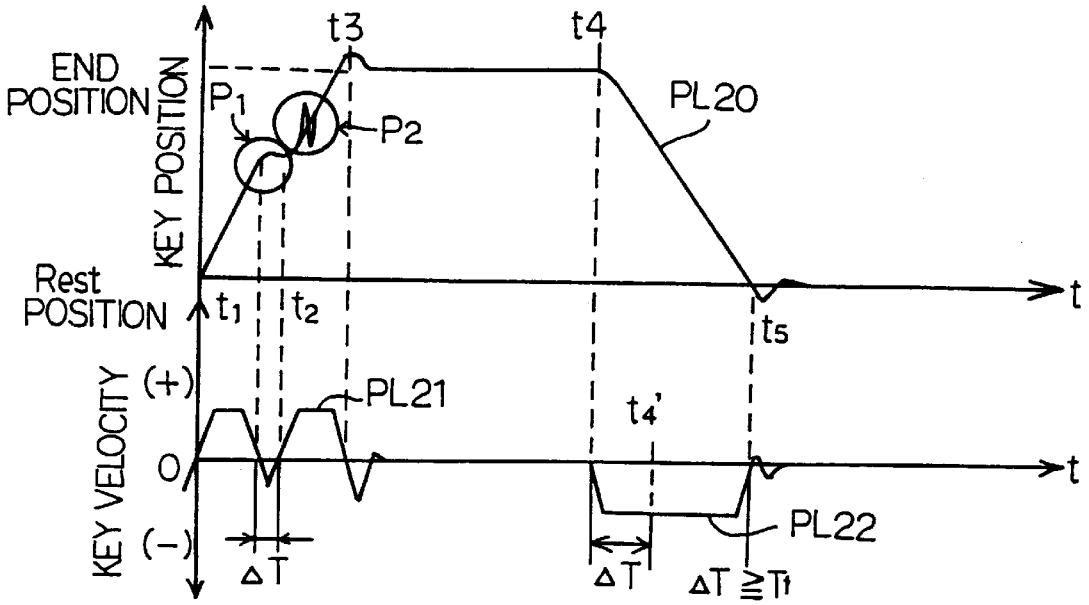
FIG. 6 is a view showing a key motion and a corresponding key velocity in terms of time.

As described hereinbefore, the selector 121 has a dead zone. The reason for the dead zone is hereinbelow described with reference to FIG. 6. When a black/white key of an acoustic piano is depressed, the depressed key is moved along plots PL20, and the key velocity is varied as indicated by plots PL21 and PL22. The depressed key proceeds toward the end position from time t1 to time t3, and stays at the end position between time t3 and time t4. The key is released at time t4, and returns to the rest position at time t5. However, the depressed key is backwardly moved around time t2 as encircled in P1, and vibrates as encircled in P2. The key motion in P1/P2 is usually unintentional. If the selector 121 is too sensitive to the key motion, the sensor 121 changes the destination of the digital key position code DSp from the data table 117 to the data table 118 in the short period ΔT, and the destination is frequently changed between the data tables 117 and 118 in the time period P2. However, such a frequent change results in unintentional discontinuity of the reaction, and the key touch becomes different from the piano key touch. For this reason, the sensor 121 does not change the destination in so far as the time period ΔT does not exceed minimum time period Tf. In other words, the sensor 121 continuously supplies the digital key position code DSp to selected one of the data tables 117/118 until exceeding the minimum time period. Thus, the dead zone is conducive to the production of the piano key touch.

As will be understood from the foregoing description, the controlling unit according to the present invention achieves the following advantages. First, the controlling unit selects one of the two groups of the first key touch codes respectively representative of the reaction under the forward motion and the reaction under backward key motion depending upon the direction of the key motion, and the solenoid-operated key actuator produces the piano key touch.

The controlling unit selects the first to third reaction components by using two different physical quantities, i.e., the key position/the key velocity and the key position/the key acceleration, and the two physical quantities exactly identify each of the first to third reaction components complicatedly varied along the trajectory of each key.

Finally, the reaction is calculated from the first to third reaction components representative of the different origins of the reaction such as the viscous load and the inertial load independently varied along the trajectory, and this makes the variation of reaction close to the piano key touch.

Modifications

Figure 7A:
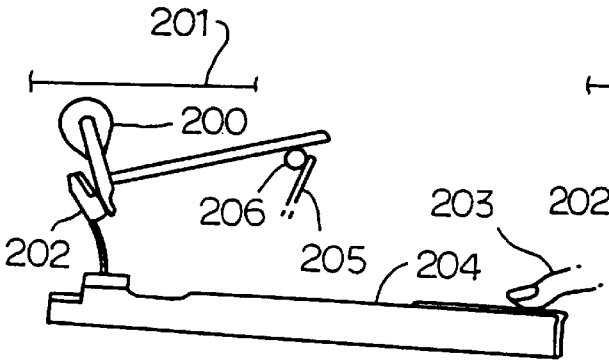
FIGS. 7A and 7B are side views showing a hammer received by a back check.
Figure 7B:
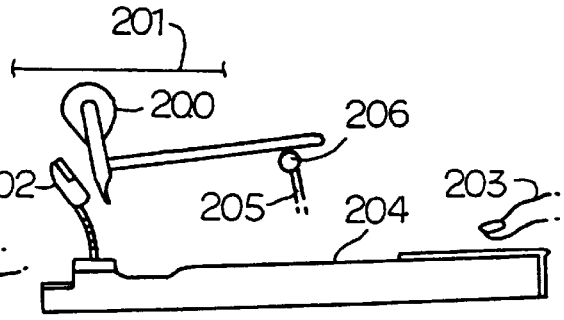
Figure 8A:
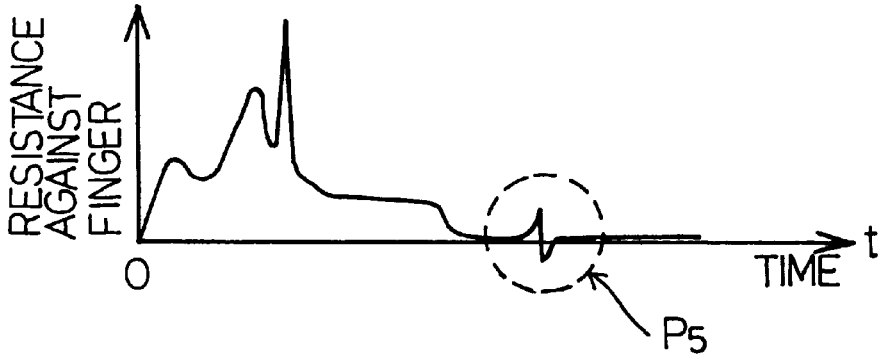
FIG. 8A is a graph showing variation of resistance against a player in case of an acoustic piano equipped with a back check.
Figure 8B:
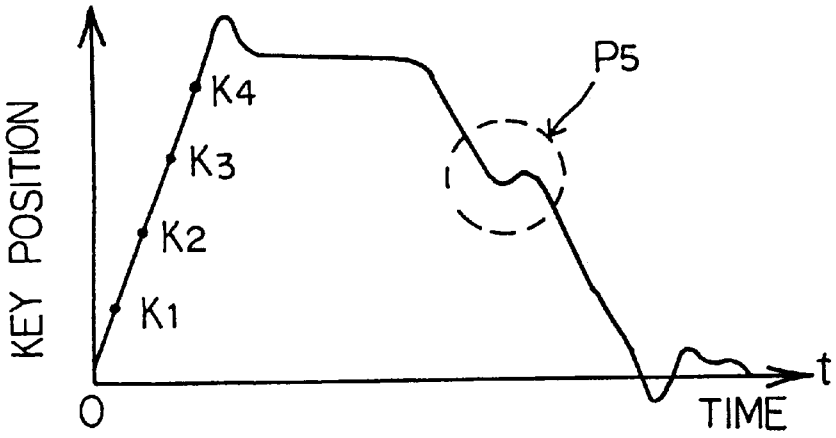
FIG. 8B is a graph showing variation of position of the key incorporated in the acoustic piano.
Figure 8C:
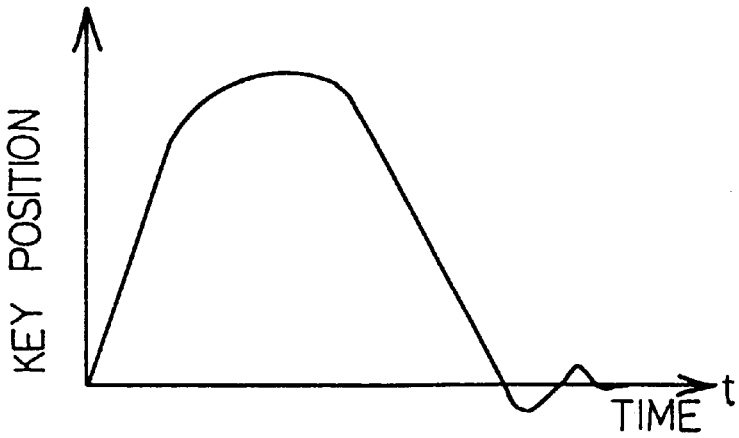
FIG. 8C is a graph showing variation of position of a key incorporated in an acoustic piano without a back check.

A standard acoustic piano is equipped with a back check, and the back check prevents the strings from undesirable double strike. In detail, the hammer 200 rebounds on the strings 201 after the strike. The hammer 200 is received by the back check 202 as shown in FIG. 7A, and the back check 202 is held in contact with the hammer 200 while the finger 203 of the player keeps the black/white key 204 at the end position. The hammer 200 trembles on the back check, and the trembles affect the resistance against the finger 203. The jack 205 is not engaged with the hammer roller 206. After the black/white key 204 is released, the back check 202 is spaced from the hammer 200, and the jack 205 is engaged with the hammer roller 206 as shown in FIG. 7B. Thus, when the key 204 is strongly depressed, the resistance against the finger is varied during the trembles P5 as shown in FIG. 8A, and the key position is varied as shown in FIG. 8B. However, when the back check is not equipped with the acoustic piano, the key is traced along the trajectory shown in FIG. 8C. Even if the player 203 gently depresses the key 204, the hammer 200 also trembles. However, the trembles are ignoreable.

As described hereinbefore, the back check 202 has the influence on the resistance when the player strongly depresses the key 204. For this reason, the first modification has detecting points K1, K2, K3 and K4 on the trajectory of the black/white key 101*a*. The detecting points K1 to K4 are discriminative on the basis of the key position X, and the central processing unit 106 calculates the key velocity on the basis of the lapse of time between the detecting point K1 to K4 and the previous point. An electronic keyboard musical instrument usually has the detecting points K1 to K4 so as to calculate the key velocity, and the central processing unit 106 calculates the key velocity Vel1 at the detecting point K1 and the key velocity Vel2 at the detecting point Vel2. The central processing unit further calculates the ratio a between the key velocities Vel2/Vel1. Using the ratio α and the key velocity Velk at any detecting point, the central processing unit determines whether or not the trembles affect the resistance. For example, if the key velocity Vel is greater than 0.2 m/s and the ratio a is greater than 1.2, the central processing unit decides that the trembles affect the resistance. On the other hand, if the key velocity Vel is equal to or less than 0.2 m/s and the ratio α is equal to or less than 1.2, the central processing unit 106 decides that the trembles are ignoreable.

In order to add the reaction component due to the trembles of the hammer to the target reaction Sum, an adder 210 is connected between the adder 126 and the modification table 122, and supplies the fourth reaction component representative the trembles to the adder 210 at appropriate timing. A plurality of sets of fourth reaction component are stored in a memory such as, for example, the read only memory 107, and one of the sets of fourth reaction components is selected by using the key velocity Vel are sequentially read out from the memory when the black/white key enters into P5 on the trajectory. However, the appropriate timing may be variable depending upon the key velocity.

Another modification takes the influence of a damper pedal 220 into account. As described hereinbefore, when the pianist depresses the damper pedal of the acoustic piano, the damper assembly does not change the resistance, and the variation of resistance becomes different. For this reason, the second modification monitors the damper pedal 220, and changes the key touch data codes stored in the data tables 117 to 120.

Thus, any component is taken into account in so far as the parameter affects the key touch. The influence of the component is converted into a reaction component, and the reaction component is stored in a data table 230 as key touch data codes. The key touch data codes are sequentially read out from the data table 230, and an adder 231 adds the reaction component to the target reaction. In this way, any component is taken into the target reaction.

Yet another modification calculates variation of the key acceleration, and uses the variation to select the key touch data codes. The variation of acceleration is used for controlling the riding quality of a vehicle, and is an important factor for human sense.

The program for controlling the key touch and the contents of the data tables 117 to 120 and 230 may be supplied from an information storage medium to the controlling unit 104 or a server through an information communicating network to the controlling unit 104.

Figure 9:
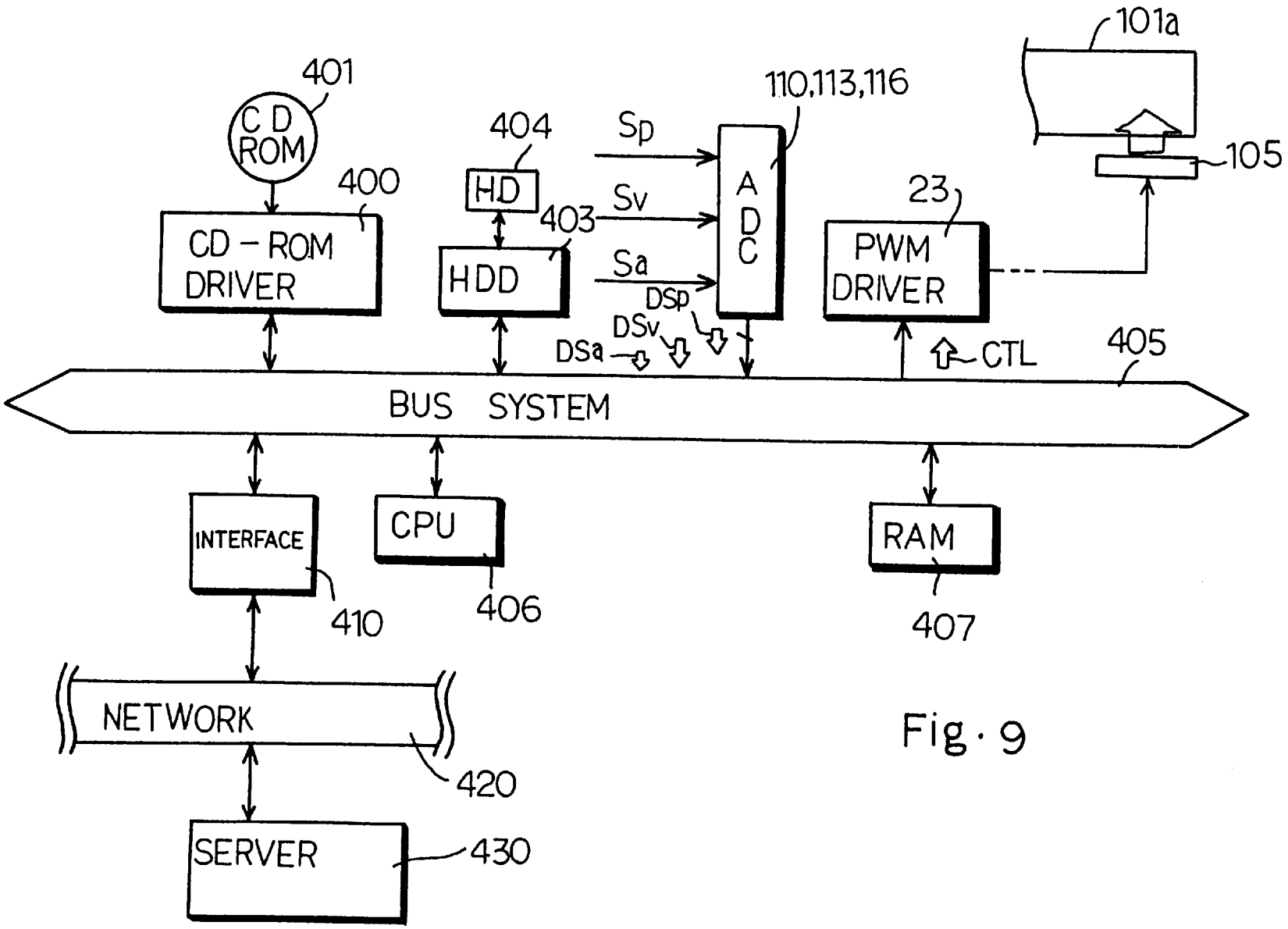
FIG. 9 is a block diagram showing the arrangement of another keyboard musical instrument with a built-in computer according to the present invention.

FIG. 9 illustrates another electronic keyboard musical instrument equipped with a built-in computer system. The electronic keyboard musical instrument comprises a CD-ROM (Compact Disk Read Only Memory) driver 400, a hard disk driver 403 and a hard disk 404. The CD-ROM driver 400 may be replaced with a floppy disk driver or a magneto-optical disk driver. The program and the contents of data tables are stored in a CD-ROM disk 401, and the CD-ROM driver 400 reads out the program and the contents of data tables from the CD-ROM disk 401. The program and the contents of data tables are transferred from the CD-ROM driver 400 through a bus system 405 to the hard disk driver 403. The hard disk driver 403 magnetically stores the program and the contents of data tables in the hard disk 404.

The electronic keyboard musical instrument further comprises a central processing unit 406 and a random access memory 407 connected to the bus system 405. The contents of data tables may be transferred from the hard disk 404 to the random access memory 407 so as to form the data tables 117 to 120 and 230 therein. The central processing unit 406 sequentially fetches the instruction codes of the program, and executes the instruction codes so that the electronic keyboard musical instrument behaves as described hereinbefore. The analog positional signals Sp, Sv and Sa are converted to the digital positional signal DSp, the digital velocity signal DSv and the digital acceleration signal DSa, and the central processing unit 406 determines the digital key touch code Dsum by using the data tables 117 to 120 and 230 stored in the hard disk 404 as described hereinbefore. The controlling signal CTL is produced from the digital key touch code Dsum, and is supplied to the pwm driver 23. The pwm driver 23 causes the current feedback circuit 124 (not shown in FIG. 9) to supply the driving signal DR to the solenoid-operated actuator 105.

The electronic keyboard musical instrument further comprises a communication interface 410, and the central processing unit 406 is communicable through the communication interface 410 and the local area network 420 to a server 430. When the central processing unit 406 supplies a command for requesting a download through the communication interface 410 and the communication network 420 to the server 430, the server 430 supplies the program and the contents of data tables through the local area network 420 to the interface 410. The program and the contents of data tables are transferred to the hard disk driver 403, and are stored therein. The central processing unit 406 executes the program so as to control the solenoid-operated actuator 105.

Although the particular embodiment of the present invention have been shown and described, it will be obvious to those skilled in the art that various changes and modifications may be made without departing from the spirit and scope of the present invention.

For example, a mechanical sensor is available for the key sensor in so far as the output is successively varied depending upon the current key position.

The solenoid-operated actuator is replaceable with an electric motor such as a linear motor or a rotary motor, a braking mechanism, a pneumatic actuator or a hydraulic actuator.

The current key position and the current key velocity may be directly determined by using different sensors.

The selector 121 may selects one of the data tables 117/118 depending upon the sign bit of the key acceleration X".

The key touch codes in the data table 119/120 may be divided into two groups for the key motion from the rest position to the end position and vice versa. In this instance, a selector changes the destination of the digital key velocity code DSv and/or the digital key acceleration code DSa depending upon the direction of the key. The selector may have a dead zone as similar to the selector 121. The minimum time periods for these selectors may be different from each other.

The resistance may be varied together with lapse of time from the rest position or a point at which the key velocity/key acceleration is zero.

The resistance may be applied to the key motion from the rest position to the end position, only.

The controlling unit 104 and the modifications may produce a key touch of another acoustic keyboard musical instrument such as an organ or an arbitrary key touch. In this instance, the electronic keyboard musical instrument may have a key switch circuit, a tone generator and a timbre selector, and the key touch may be selected in accordance with the selected timbre.

What is claimed is:

1. A keyboard musical instrument comprising at least one key movable between a rest position and an end position, a first monitoring means associated with said at least one key and producing a first signal representative of a first physical quantity varied between said rest position and said end position for defining current status of said at least one key from a certain angle, a second monitoring means associated with said at least one key and producing a second signal representative of a second physical quantity varied between said rest position and said end position and different from said first physical quantity for defining said current status of said at least one key from another angle, a first data table storing first pieces of reaction data information representative of a first reaction component to a motion of said at least one key and grouped by said first physical quantity, said first data table being responsive to said first signal for selecting a group of first pieces of reaction data information and to said second signal for selectively outputting said first pieces of reaction data information of said group, and a reaction generating means responsive to said first pieces of reaction data information selectively outputted for giving a resistance against said motion of said at least one key.

2. A keyboard musical instrument comprising at least one key movable between a rest position and an end position, a first monitoring means associated with said at least one key and producing a first signal representative of a first physical quantity varied between said rest position and said end position for defining current status of said at least one key from a certain angle, a second monitoring means associated with said at least one key and producing a second signal representative of a second physical quantity varied between said rest position and said end position and different from said first physical quantity for defining said current status of said at least one key form another angle, a first data table storing first pieces of reaction data information representative of a first reaction component to a motion of said at least one key and grouped by said first physical quantity and including a first data sub-table for storing selected ones of said first pieces of reaction data information representative of a first reaction to a motion of said at least one key from said rest position to said end position and a second data sub-table for storing remaining ones of said first pieces of reaction data information representative of a second reaction to a motion of said at least one key from said end position to said rest position, said first data table being responsive to said first signal for selecting a group of first pieces of reaction data information and to said second signal for selectively outputting said first pieces of reaction data information of said group, a selector connected between said first monitoring means and said first and second data sub-tables and responsive to said second signal for connecting said first monitoring means to one of said first and second data sub-tables, and a reaction generating means responsive to said first pieces of reaction data information selectively outputted for giving a resistance against said motion os said at least one key.

3. A keyboard musical instrument comprising at least one key movable between a rest position and an end position, a first monitoring means associated with said at least one key and producing a first signal representative of a first physical quantity varied between said rest position and said end position for defining current status of said at least one key from a certain angle, a second monitoring means associated with said at least one key and producing a second signal representative of a second physical quantity varied between said rest position and said end position and different from said first physical quantity for defining said current status of said at least one key form another angle, a first data table storing first pieces of reaction data information representative of a first reaction component to a motion of said at least one key and grouped by said first physical quantity, said first data table being responsive to said first signal for selecting a group of first pieces of reaction data information and to said second signal for selectively outputting said first pieces of reaction data information of said group, a said second data table storing second pieces of reaction data information representative of a second reaction component to said motion of said at least one key, different in origin from said first reaction component and grouped by said second physical quantity, said second data table being responsive to said second signal for selecting a group of said second pieces of reaction data information and to said first signal for selectively outputting said second pieces of reaction data information of said group, and a reaction generating means responsive to said first pieces of reaction data information selectively outputted for giving a resistance against said motion of said at least one key, said reaction generating means being responsive to said first pieces of reaction data information selectively outputted and said second pieces of reaction data information selectively outputted for giving a resistance against said motion of said at least one key.

4. The keyboard musical instrument as set forth in claim 3, further comprising a third monitoring means associated with said at least one key and producing a third signal representative of a third physical quantity varied between said rest position and said end position and different from said first physical quantity and said second physical quantity for defining said current status of said at least one key from yet another angle, and a third data table storing third pieces of reaction data information representative of a third reaction component to said motion of said at least one key, different in origin from said first and second reaction components and grouped by said first physical quantity, said third data table being responsive to said first signal for selecting a group of said third pieces of reaction data information and to said third signal for selectively outputting said third pieces of reaction data information of said group, said reaction generating means being responsive to said first pieces of reaction data information selectively outputted, said second pieces of reaction data information selectively outputted and said third pieces of reaction data information selectively outputted for giving a resistance against said motion of said at least one key.

5. The keyboard musical instrument as set forth in claim 4, in which said first physical quantity, said second physical quantity and said third physical quantity are a position on a trajectory of said at least one key between said rest position and said end position, a velocity of said at least one key and an acceleration of said at least one key, respectively.

6. A keyboard musical instrument comprising at least one key movable between a rest position and an end position, a monitoring means associated with said at least one key and producing a signal for defining current status of said at least one key, a data table storing pieces of reaction data information and divided into a first group representative of a motion of said at least one key from said rest position and said end position and a second group representative of a motion of said at least one key from said end position to said rest position and responsive to said signal for selectively reading out said pieces of reaction data information, a selecting means for selecting said first group or said second group depending upon a direction of said motion of said at least one key, and a reaction generating means responsive to said pieces of reaction data information selectively outputted from said first group or said second group specified by said selecting means for giving a resistance against said motion of said at least one key.

7. A keyboard musical instrument comprising at least one key movable between a rest position and an end position, a monitoring means associated with said at least one key and producing a signal for defining current status of said at least one key, and including a first monitoring sub-means for producing a first sub-signal of said signal representative of a first physical quantity varied between said rest position and said end position for defining current status of said at least one key from a certain angle and a second monitoring sub-means for producing a second sub-signal of said signal representative of a second physical quantity varied between said rest position and said end position and different from said first physical quantity for defining said current status of said at least one key from another angle, a data table storing pieces of reaction data information and divided into a first group representative of a motion of said at least one key from said rest position to said end position and a second group representative of a motion of said at least one key from said end position to said rest position and responsive to said signal for selectively reading out said pieces of reaction data information, said first group and said second group being respectively grouped into a plurality of first sub-groups and a plurality of second sub-groups by said second physical quantity, one of said plurality of first sub-groups or said plurality of second sub-groups being selected by said second sub-signal, the pieces of reaction data information being selectively read out from selected one of said plurality of first sub-groups or selected one of said plurality of second sub-groups, a selecting means for selecting said first group or said second group depending upon a direction of said motion of said at least one key, and a reaction generating means responsive to said pieces of reaction data information selectively outputted from said first group or said second group specified by said selecting means for giving a resistance against said motion of said at least one key.

8. The keyboard musical instrument as set forth in claim 7, further comprising another data table for storing first other pieces of reaction data information grouped into a plurality of first other data groups by said first physical quantity and responsive to said first sub-signal for selecting one of said plurality of first other data groups and to said second sub-signal for selectively reading out the first other pieces of reaction data information from selected one of said plurality of first other data groups, said reaction generating means being responsive to said pieces of reaction data information selectively read out from said one of said plurality of first sub-groups or selected one of said plurality of second sub-groups and said first other pieces of reaction data information selectively read out from said selected one of said plurality of first other data groups.

9. The keyboard musical instrument as set forth in claim 8, said monitoring means further includes a third monitoring sub-means monitoring sub-means for producing a third sub-signal of said signal representative of a third physical quantity varied between said rest position and said end position and different from said first physical quantity and said second physical quantity for defining said current status of said at least one key from yet another angle, said keyboard musical instrument further comprising yet another data table for storing second other pieces of reaction data information grouped into a plurality of second other data groups by said first physical quantity and responsive to said first sub-signal for selecting one of said plurality of second other data groups and to said third sub-signal for selectively reading out the second other pieces of reaction data information from selected one of said plurality of second other data groups, said reaction generating means being responsive to said pieces of reaction data information selectively read out from said one of said plurality of first sub-groups or selected one of said plurality of second sub-groups, said first other pieces of reaction data information selectively read out from said selected one of said plurality of first other data groups and said second other pieces of reaction data information selectively read out form said selected one of said plurality of second other data groups.

10. The keyboard musical instrument as set forth in claim 7, in which said selecting means selects one of said first group and said second group by using a sign bit of said second sub-signal, and said selector escapes from a dead zone when change of said sign bit continues over a predetermined time period.

* * * * *